US012747635B2

(12) United States Patent
Belaskie et al.

(10) Patent No.: US 12,747,635 B2
(45) Date of Patent: Sep. 29, 2026

(54) SYSTEMS AND METHODS FOR HEAVE COMPENSATION

(71) Applicant: Schlumberger Technology Corporation, Sugar Land, TX (US)

(72) Inventors: James Philip Belaskie, Houston, TX (US); Nathaniel Wicks, Cambridge, MA (US); Xianxiang Huang, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 460 days.

(21) Appl. No.: 18/331,221

(22) Filed: Jun. 8, 2023

(65) Prior Publication Data

US 2024/0410228 A1 Dec. 12, 2024

(51) Int. Cl.

| | |
|---|---|
| ***E21B 7/128*** | (2006.01) |
| ***B63B 35/44*** | (2006.01) |
| ***B63B 39/02*** | (2006.01) |

(52) U.S. Cl.

CPC ..... *E21B 7/128* (2013.01); *B63B 35/4413* (2013.01); *B63B 39/02* (2013.01)

(58) Field of Classification Search

CPC ..... E21B 7/128; B63B 35/4413; B63B 39/02

See application file for complete search history.

(56) References Cited

U.S. PATENT DOCUMENTS

| | | | | |
|---|---|---|---|---|
| 10,108,155 | B2 | 10/2018 | Aldred et al. | |
| 2009/0164125 | A1* | 6/2009 | Bordakov | E21B 47/04 702/6 |
| 2014/0288847 | A1* | 9/2014 | Zhang | G16B 30/00 702/19 |
| 2018/0298746 | A1* | 10/2018 | Short | E21B 41/00 |

* cited by examiner

*Primary Examiner* — Catherine T. Rastovski

(74) *Attorney, Agent, or Firm* — Kyle R. Milller

(57) ABSTRACT

A position manager may receive time-based block position data of a travelling block above a drill floor on a floating drill rig, wherein the time-based block position data is received from a block position sensor on the drill floor. A position manager may apply a changepoint model to the time-based block position data to separate the time-based block position data into a plurality of segments. A position manager may determine a best segment of the plurality of segments. A position manager may generate a de-sensitized block position using the best segment of the plurality of segments.

20 Claims, 9 Drawing Sheets

SYSTEMS AND METHODS FOR HEAVE COMPENSATION

BACKGROUND OF THE DISCLOSURE

Drilling is used to access subterranean formations for exploration, the extraction of natural resources (e.g., oil, natural gas, water), power generation, other uses, and combinations thereof. A downhole drilling system includes a bit that is connected to a drill string and/or other downhole tools. In some situations, downhole drilling systems may drill into the seabed under the ocean on a floating drill rig. While drilling, the floating drill rig may experience heave, or may move vertical position based on the swell interacting with the floating drill rig.

SUMMARY

In some aspects, the techniques described herein relate to a method for drilling. A position manager receives time-based block position data of a travelling block above a drill floor on a floating drill rig. The time-based block position data is received from a block position sensor on the drill floor. The position manager applies a changepoint model to the time-based block position data to separate the time-based block position data into a plurality of segments. The position manager determines a best segment of the plurality of segments. The position manager generates a de-sensitized block position using the best segment of the plurality of segments.

In some aspects, the techniques described herein relate to a method implemented in a drilling system. A position manager receives a plurality of block positions over time of a travelling block above a drill floor on a floating drill rig. The plurality of block positions are associated with a depth of a bit in a wellbore. The position manager applies a changepoint model to the plurality of block positions to identify a de-sensitized block position of the plurality of block positions. Based on the de-sensitized block position, the position manager identifies a change in drilling conditions.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2 is a representation of a position manager used to determine a de-sensitized bit position of a drilling system, according to at least one embodiment of the present disclosure;

FIG. 3-1 is a representation of a depth plot for a drilling system, according to at least one embodiment of the present disclosure;

FIG. 3-2 is a representation of the depth plot of FIG. 3-1 having a changepoint model applied;

DETAILED DESCRIPTION

Figure 1:
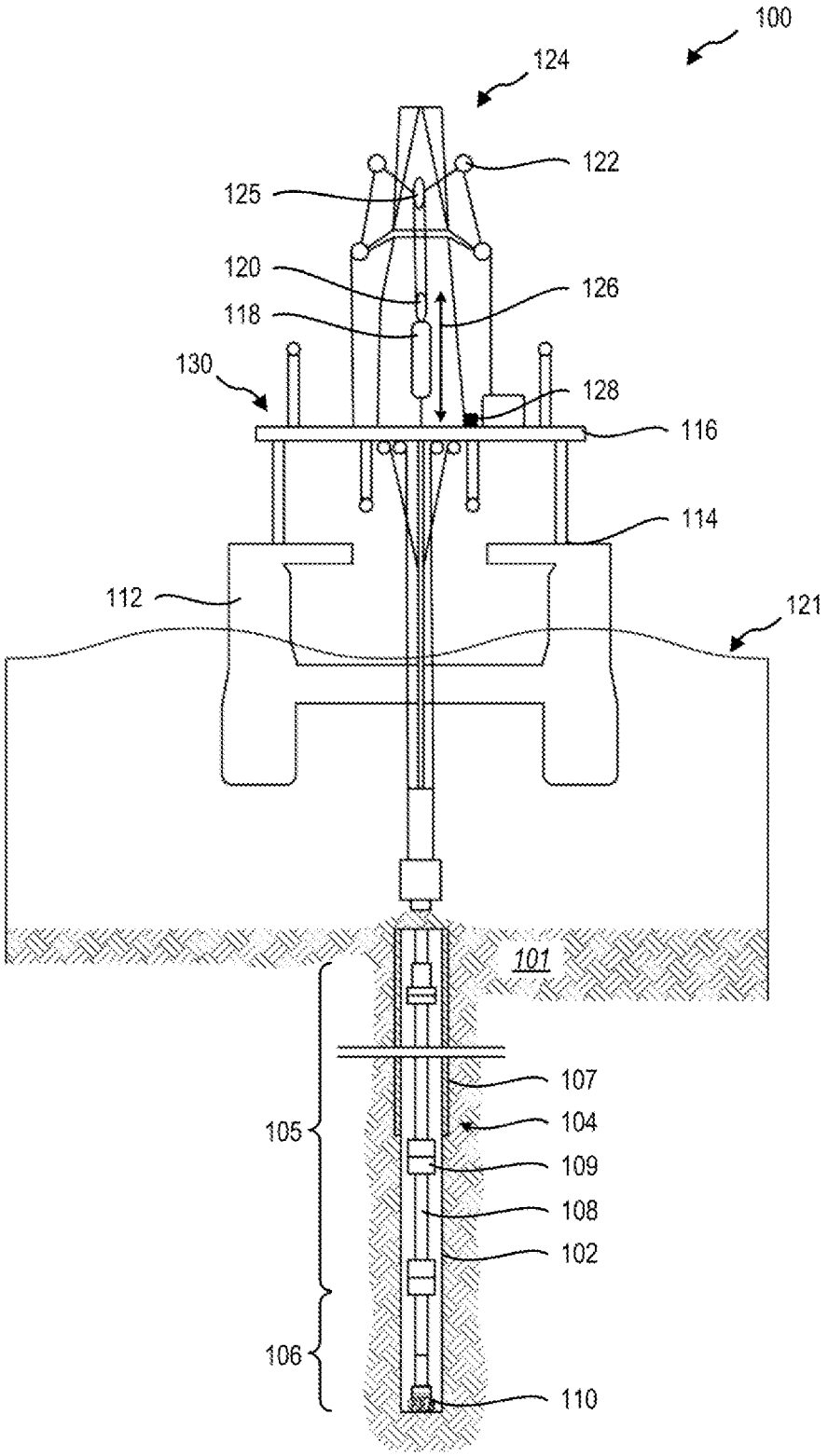
FIG. 1-1 and FIG. 1-2 show an example of a drilling system for drilling an earth formation to form a wellbore, according to at least one embodiment of the present disclosure.

This disclosure generally relates to devices, systems, and methods for determining a block position of a traveling block on a floating drill rig experiencing heave at a deep-sea drilling location. Floating drill rigs may be subject to heave, or vertical motion caused by swells in the ocean. The swells may have a total height of up to 10 m or more (e.g., from trough to peak). A traveling block is connected to the drill string and used to help lower the drill string. In some situations, the bit position downhole is determined based on the position of the traveling block. For example, the bit position may be determined based on a height of the traveling block above the drill floor. When drilling while experiencing heave, the traveling block may experience vertical motion based on the heave. This may reduce the effectiveness of the traveling block to lower the drill string, including maintaining a consistent surface weight-on-bit (SWOB).

To at least partially compensate for the heave, the floating drill rig may include a compensator connected to the travelling block. The compensator may include a hydraulic system that raises and lowers the traveling block to maintain the absolute position of the traveling block over the bit. This may help to improve the drilling process, including maintaining the SWOB. In some situations, the compensator may compensate for all of the heave. In some situations, the compensator may not compensate for at least a portion of the heave. This may result in a traveling block position that varies relative to the heave, such as with a lower amplitude. Measuring the traveling block position may result in a bit depth that varies based on the heave. This may increase the difficulty in determining the bit depth and the information associated with it, such as rate of penetration (ROP).

In some situations, the hole depth may be determined using a combination of measurements from a combination of sensors. For example, the hole depth may be determined by a combination of one or more of the traveling block position above the drill floor, the distance from the drill floor to the top of the riser slip joint, and the distance from the drill floor to the crown block. In one or more instances, obtaining such a combination of measurements may be complex in nature.

For example, installing sensors in remote portions of the floating drill rig may be difficult and/or hazardous for an operator to perform. In some examples, the three sensors may be difficult to synchronize, which may introduce inaccuracies in the bit depth measurement.

In accordance with at least one embodiment of the present disclosure, the position of the bit may be determined using time-based measurements of a block position representative of a distance between traveling block position and the drill floor. The block position data may be time-based, where each block position measurement is associated with a time stamp. A position manager may receive the block position data from a single block position sensor on the drill floor. The position manager may apply a changepoint model to the time-based block position data. The changepoint model may determine one or more segments of the time-based block position data, with each segment separated by a changepoint. These segments may be used to determine a de-sensitized block position. The position manager may use the de-sensitized block position to determine the position of the bit without the variability introduced by the floating drill rig experiencing heave. This may help the drilling system to identify and react to change in the drilling conditions.

Figures 1, 2:
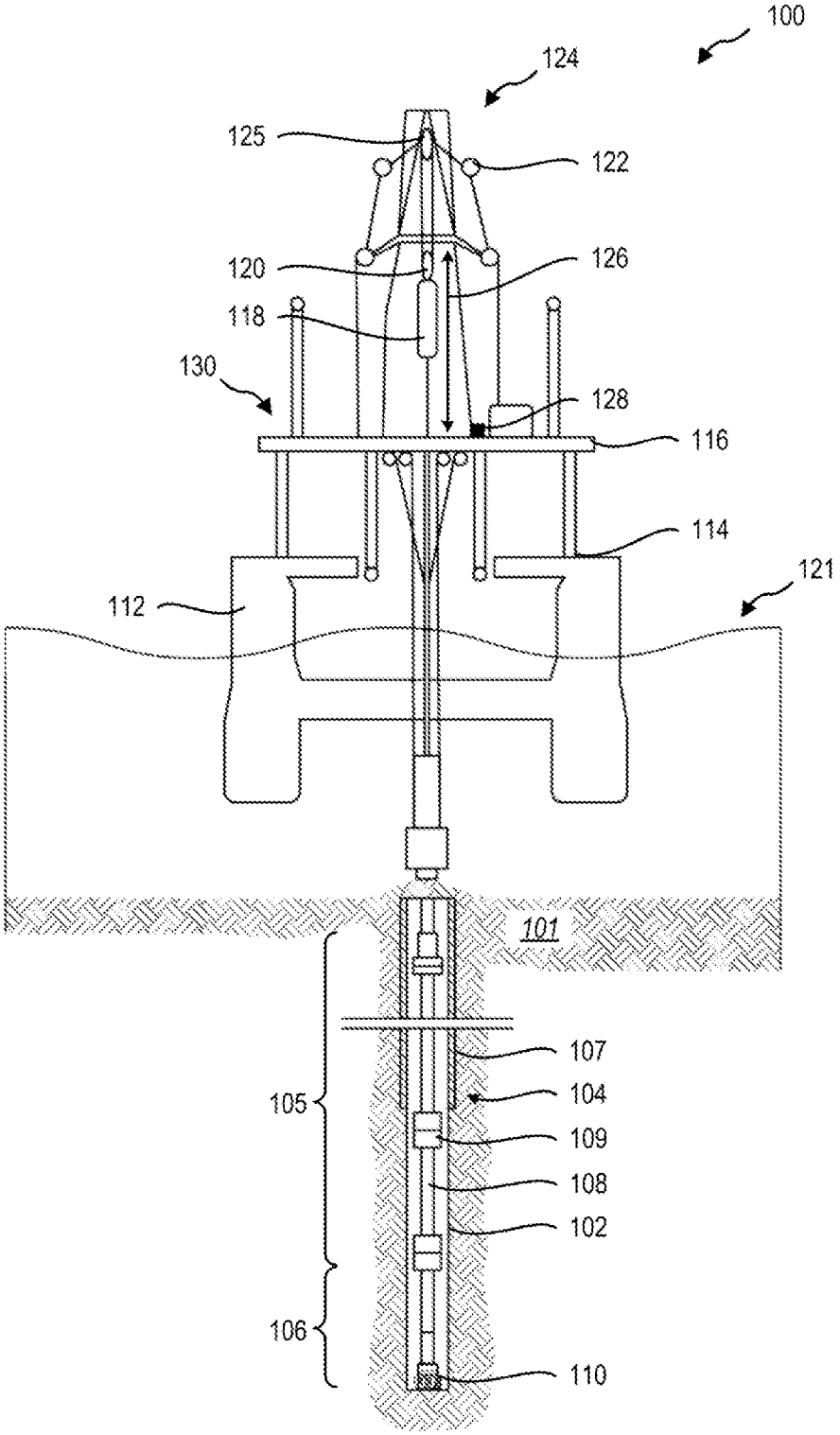
Figure 2:
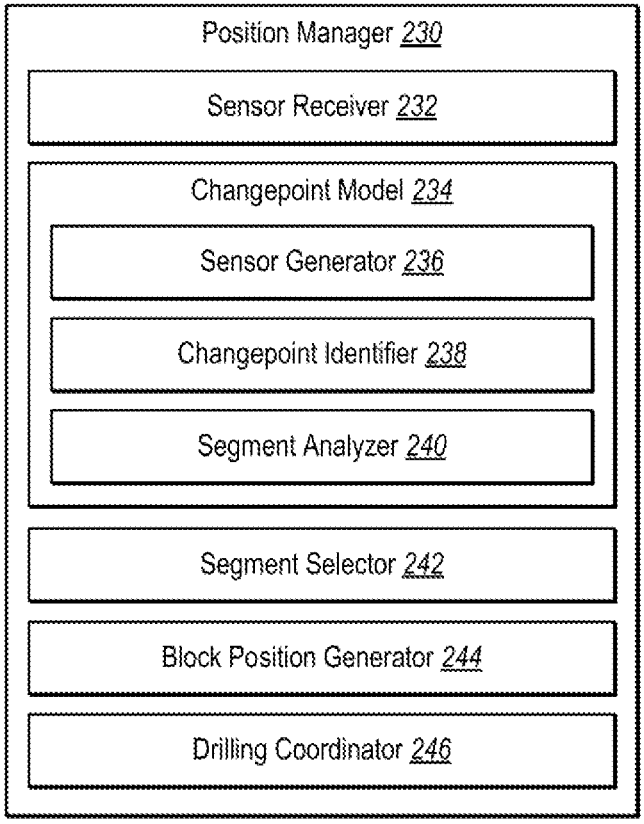

FIG. 1-1 and FIG. 1-2 show an example of a drilling system 100 for drilling an earth formation 101 to form a wellbore 102. The drilling system 100 includes a floating drill rig 130 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the floating drill rig 130 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

The floating drill rig 130 may include a drilling unit 112 having a main deck 114 supported by the drilling unit 112 and a drill floor 116 supported over the main deck 114. Drilling activities may occur on the drill floor 116, including adding and/or removing lengths of the drill string 105, adding and/or removing portions of the BHA 106, any other drilling activity, and combinations thereof. A drilling string support 118 may be connected to the drill string 105 above the drill floor 116. The drilling string support 118 may include any type of support, such as a kelly, a top drive, a hook, any other support, and combinations thereof.

A travelling block 120 may support the drilling string support 118. The travelling block 120 may be connected to a crown area 124 with one or more cables or pulleys. During heave, the floating drill rig 130 may move up and down with swells 121 on the ocean surface. A compensator 122 located in the crown area 124 of the floating drill rig 130 may adjust the vertical position of the travelling block 120 above the drilling string support 118 by adjusting the position of a crown block 125 in the crown area 124. Cables between the crown block 125 and the travelling block 120 may be held in tension using one or more tensioners.

As discussed herein, the depth of the bit 110 may be determined based on the block position 126, which is representative of the distance between the drill floor 116 and the travelling block 120. The block position 126 may be measured using a block position sensor 128 located on the drill floor 116. The block position sensor 128 may collect time-based block position data. Put another way, the block position sensor 128 may collect a series of block position measurements and associate each of these measurements with a time stamp.

During heave, the block position 126 may change based on incomplete compensation by the compensator 122. For example, the compensator 122 may include a hydraulic system that may have a delayed response to changes in elevation of the floating drill rig 130 due to heave. This may result in a block position 126 that changes in heave. In some embodiments, the block position 126 may change with the same frequency and/or amplitude (e.g., the height from the trough to the peak) of the swells 121. In some embodiments the block position 126 may change with a different frequency and/or amplitude than the swells 121. For example, in the position shown in FIG. 1-1, the block position 126 is smaller than the block position 126 shown in FIG. 1-2.

As discussed herein, the bit depth of the bit 110 may be determined based on the block position 126 as measured using the block position sensor 128 on the drill floor 116. If the block position 126 changes (and the changes are not solely due to advancement of the wellbore and/or tripping), then the recorded bit depth may change as well. Changes in recorded bit depth due to heave may result in an ROP that is characterized by periods of high ROP followed by periods of low (or zero) ROP. Such variable ROP increase the difficulty of identifying trends in ROP. These ROP trends may help to identify changes in drilling conditions at the BHA 106. Changes in the drilling conditions that may be identified may include, but may not be limited to, changes in formation hardness, changes in equipment operation of the BHA 106, any other changes in drilling conditions, and combinations thereof.

Conventionally, determining the bit depth using the block position 126 occurs using an average, such as a running average (e.g., an average based on a past number of measurements and/or a past duration of measurements), a weighted average, other average, and combinations thereof. But changes in ROP may not be identified and compensated for until the change has passed using averages, making it difficult to identify when a change in ROP occurs. Further, averages may not accurately determine the bit depth in situations of variable heave, including variable amplitude and/or frequency of the swells 121 causing the heave.

In accordance with at least one embodiment of the present disclosure, a position manager may receive the block position 126 measurements and may generate a de-sensitized block position of the travelling block 120. To generate the de-sensitized block position, the position manager may apply a changepoint model to the time-based block position data. The changepoint model may segmentize, or generate a plurality of segments, using the time-based block position data. Put another way, the changepoint model may separate the time-based block position data into a plurality of segments. The changepoint model may apply a segment weight to each of the segments. The segment weight may be based on any factor, such as the fit of the segment to the time-based block position data. The changepoint model may select a best segment based on the segment weights. For example, the changepoint model may select the segment having the highest weight as the best segment. Using the best segment from the plurality of segments, the position manager may generate a de-sensitized block position of the travelling block 120. By applying the changepoint model to the time-based block position data, multiple de-sensitized block positions may be generated. The de-sensitized block positions may be used to generate a de-sensitized bit position of the bit 110. The de-sensitized bit position may be used to generate a de-sensitized ROP of the drilling system 100. This de-sensitized bit position and ROP may be more accurate and/or more representative of the actual bit position and ROP of the drilling system 100. In this manner, a drilling manager and/or drilling system may use the de-sensitized bit position and/or ROP to identify changing drilling conditions and prepare a response to the changing conditions.

In some embodiments, this identification and/or response to changing conditions may occur while the drilling system 100 is performing drilling activities. For example, the changepoint model may be applied in real-time. In some examples, the de-sensitized bit position and/or ROP may be generated while performing drilling activities. This may allow the drilling system 100 to be responsive to changing conditions, such as by changing one or more drilling parameters based on the de-sensitized bit position and/or ROP.

FIG. 2 is a representation of a position manager 230 used to determine a de-sensitized bit position of a drilling system, according to at least one embodiment of the present disclosure. Each of the components of the position manager 230 may include software, hardware, or both. For example, the components may include one or more instructions stored on a computer-readable storage medium and executable by processors of one or more computing devices, such as a client device or server device. When executed by the one or more processors, the computer-executable instructions of the position manager 230 may cause the computing device(s) to perform the methods described herein. Alternatively, the components may include hardware, such as a special-purpose processing device to perform a certain function or group of functions. Alternatively, the components of the position manager 230 may include a combination of computer-executable instructions and hardware.

Furthermore, the components of the position manager 230 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The position manager 230 may include a sensor receiver 232 that receives sensor measurements from a block position sensor located on the drill floor of a floating drill rig. The sensor receiver 232 may receive time-based block position data. For example, the sensor receiver 232 may receive a series of individual block position measurements that are each associated with a time of measurement (e.g., a time stamp). The time-based block position data may have any measurement frequency. In some embodiments, the measurement frequency may be in a range having an upper value, a lower value, or upper and lower values including any of 120 Hz, 100 Hz, 80 Hz, 60 Hz, 30 Hz, 1 Hz, 0.5 Hz, 0.1Hz, 0.01 Hz, or any value therebetween. For example, the measurement frequency may be greater than 0.01 Hz. In another example, the measurement frequency may be less than 120 Hz. In yet other examples, the measurement frequency may be any value in a range between 0.01 Hz and 120 Hz. In some embodiments, it may be critical that the measurement frequency is approximately 1 Hz to increase the resolution of the time-based block position data, thereby improving the resolution of the de-sensitized bit position.

In some embodiments, the measurement frequency may be related to the period of heave motion. For example, the measurement frequency may be sufficiently high to collect sensor measurements that will generate a profile of the heave experienced by the drilling rig. In some embodiments, the measurement frequency may be a measurement multiple of the heave frequency. In some embodiments, the measurement multiple may be 1, 2, 3, 4, 5, 6, 7, 8, 9, 10, 15, 20, 30, 40, 50, 100, or more times the heave frequency.

The heave frequency may vary depending on several factors, including the size of the waves, the shape of the waves, the depth of the water, the prevailing weather conditions, any other factors, and combinations thereof. In general, the period of heave motion in the open ocean may range from between 4 to 15 seconds. For example, small wind-generated waves may have periods of 4 to 8 seconds. Larger waves generated by storms may have periods of 10 to 15 seconds or longer. In shallow coastal areas, the period of heave may be longer based on the interaction with the seabed and shallower water depths. But it is important to note that these representations of heave periods are approximate, and may vary depending on the specific conditions of the sea.

In some embodiments, the sensor receiver 232 may receive the block position data in real-time. For example, the sensor receiver 232 may receive each block position measurement as soon as the block position sensor measures it (e.g., the block position sensor may transmit the block position measurement to the sensor receiver 232 as soon as the block position measurement is made). In some embodiments, the sensor receiver 232 may receive the block position data periodically and/or episodically. For example, the sensor receiver 232 may receive the block position data after a threshold number of measurements are made. In some examples, the sensor receiver 232 may receive the block position data after a threshold time has passed. In some examples, the sensor receiver 232 may receive the block position data after a threshold measurement value is measured. Episodic and/or periodic transmission of the block position data may help to reduce the transmission bandwidth and/or power consumption of the block position sensor. In some embodiments, the block position sensor may store the measurements in storage, and the block position data may be analyzed at a later time. In some embodiments, the block position sensor may transmit the block position data to the sensor receiver 232 in real-time or near real-time to facilitate automated control of the drilling rig.

The position manager 230 may apply a changepoint model 234 to the block position data received by the sensor receiver 232. The changepoint model 234 may analyze the time-based block position data to identify trends in the block position data. For example, the changepoint model 234 may analyze the time-based block position data to determine a change in the properties of a section. The change may be based on any feature of the time-based block position data, such as a change in the rate of change of the time-based block position data, a change in the variability of the time-based block position data, a change in the values of the time-based block position data, a change in any other feature of the time-based block position data, and combinations thereof.

The changepoint model 234 may receive one or more thresholds (e.g., priors or biases) as an input. The one or more thresholds may be used to identify changes in the block position data. The input thresholds may include, but may not be limited to, a block position range, a rate of change slope cutoff, a standard deviation of the block position, any other input threshold, and combinations thereof.

The changepoint model 234 includes a segment generator 236. Using the input thresholds and the time-based block position data, the segment generator 236 may separate the time-based block position data into multiple segments. A changepoint identifier 238 may identify changepoints between adjacent segments. In some embodiments, the segment generator 236 may generate multiple different segments that overlap the same period for the data. For example, for a particular set of measurement values and/or a particular period of time, the segment generator 236 may generate multiple overlapping segments for the same period of time. In some examples, the different overlapping segments may have the same changepoint with the immediately prior segment. In some examples, the overlapping segments may have different changepoints with the immediately prior segment. In some embodiments, a particular segment may extend across a portion of a wavelength of the swell. In some embodiments, a particular segment may extend across a single wavelength of the swell. In some embodiments, a particular segment may extend across multiple wavelengths of the swell.

In some embodiments, each of the overlapping segments may have different properties. For example, the overlapping segments may have different slopes. In some examples, the overlapping segments may have different shapes. In some examples, the overlapping segments may have different lengths. In some examples, the overlapping segments may be based on different function types, such as linear, polynomial, exponential, power, rational, logarithmic, sinusoidal, any other function type, and combinations thereof.

In some embodiments, the overlapping segments may have a different fit to the data. For example, a particular segment may have a calculated r-value that represents the correlation of the segment to the time-based block position data over the segment. In some examples, a particular segment may have a calculated p-value that represents the statistical significance of the segment to the time-based block position data. In some examples, a particular block may have both an r-value and a p-value.

The changepoint model 234 may include a segment analyzer 240. The segment analyzer 240 may analyze the overlapping segments over the period of time to generate a de-sensitized block position. For example, the segment analyzer 240 may analyze each segment to generate a de-sensitized block position predicted for a particular time and based on the equation used to generate the segment. In some examples, the segment analyzer 240 may assign a weight to some or all of the overlapping segments. The weight may be based on one or more weighing factors, including the fit of the data (including the r-value and/or the p-value), the length of the segment, the shape of the segment, the function type of the segment, the slope of the segment, any other weighing factor, and combinations thereof. In some embodiments, the weighing factors may be generated by the fits that the various segments have to the data. Segments that result in a relatively smaller total number of changepoints and/or segments may have a higher weighing than segments that result in a relatively larger number of changepoints and/or segments. In this manner, a relatively smaller number of segments may help to maintain a simpler model.

The position manager 230 may include a segment selector 242. The segment selector 242 may analyze the weighted segments to select a best segment. The segment selector 242 may select the best segment based on the relative weights of the overlapping segments. For example, the segment selector 242 may select the best segment as the segment having the highest weight. In some examples, the segment selector 242 may select the best segment having the highest value for a particular weighing factor and/or a particular combination of weighing factors. In some examples, the segment selector 242 may select a set of segments and may request that the drilling operator select the segment from the set of segments.

Using the best segment, a block position generator 244 may generate a de-sensitized block position. For example, the best segment may include a formula or other representation of the relationship between time and block position. The block position generator 244 may generate the de-sensitized block position using the best segment. As discussed above, the block position generator 244 may generate a block position for each segment of the overlapping segments and the de-sensitized block position may be the position associated with the best segment.

In some embodiments, a drilling coordinator 246 may analyze the de-sensitized block position for drilling information. For example, the drilling coordinator 246 may convert the de-sensitized block position to a de-sensitized bit depth, such as by adding the total length of the drill string and BHA to the de-sensitized block position. In some embodiments, the drilling coordinator 246 may determine a ROP for the drilling system using the de-sensitized block position and/or the de-sensitized bit depth.

In some embodiments, the drilling coordinator 246 may identify a change in drilling conditions using the de-sensitized block position and/or the de-sensitized bit depth. For example, the drilling coordinator 246 may identify a change in ROP. This may indicate a change in formation and/or other change in drilling conditions.

In some embodiments, based on the change in drilling conditions, the drilling coordinator 246 may initiate a change in one or more drilling parameters. For example, the drilling coordinator 246 may cause an automated drilling system to implement a change in drilling parameters. In some examples, the drilling coordinator 246 may instruct a drilling operator to implement a change in drilling parameters. The change in drilling parameters may include one or more of WOB, drilling fluid pressure, drilling fluid flow rate, rotational rate, any other drilling parameter, and combinations thereof. In some embodiments, implementing a change in drilling parameters may allow the drilling system to be more responsive to changes in drilling conditions. This may help to increase drilling efficiency and/or improve the overall ROP.

Figures 1, 3:
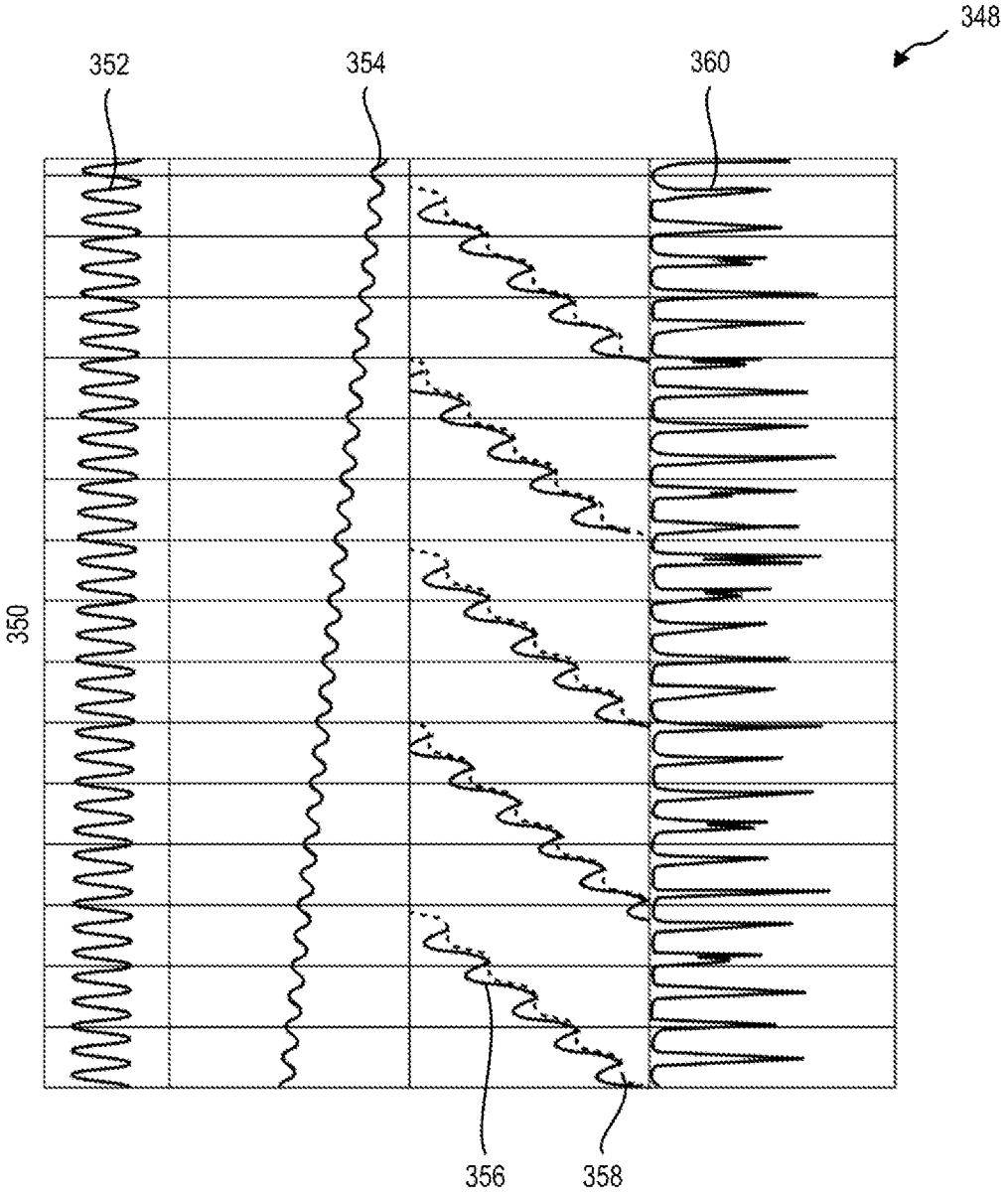
Figures 2, 3:
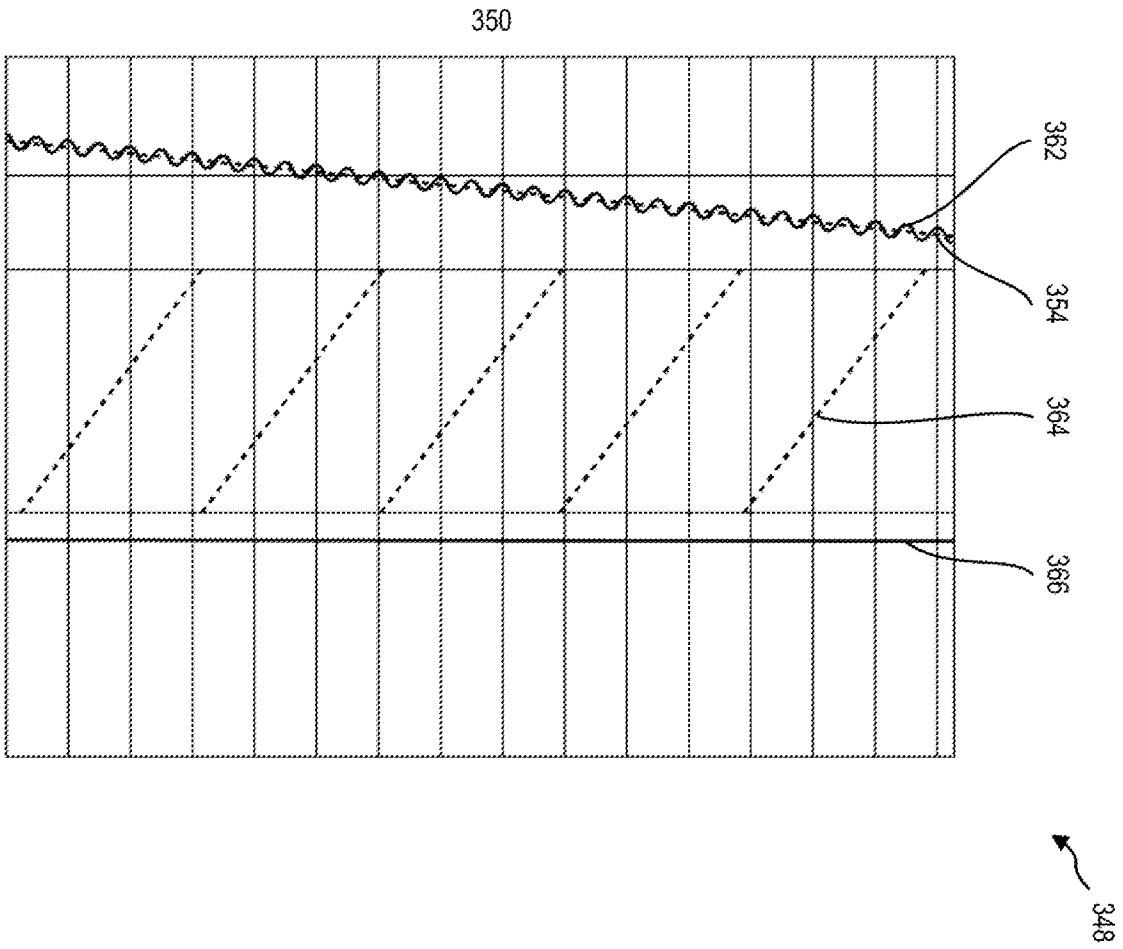

FIG. 3-1 is a representation of a depth plot 348 for a wellbore illustrating time 350 on the vertical axis (e.g., y-axis), according to at least one embodiment of the present disclosure. The lines on the depth plot 348 are generated using time-based data, including time-based block position data and time-based heave data, as described herein. The depth plot 348 shown includes a heave line 352 illustrating a swell height on the horizontal axis (e.g., x-axis). In the illustrated embodiment, the heave experienced is a regular sinusoidal pattern. The depth plot 348 shown includes a block position line 354 illustrating block position above the drill floor on the horizontal axis. As may be seen, a comparison between the heave line 352 and the block position line 354 shows that the variation in the block position line 354 approximately follows the same pattern as the heave line 352. For example, the block position line 354 has the same or a similar frequency as the heave line 352, but the block position line 354 has a lower amplitude than the heave illustrated in the heave line 352.

The depth plot 348 illustrated includes a bit depth line 356 and a hole depth line 358. The bit depth line 356 may be representative of the bit depth as calculated based on the block position line 354. As may be seen, the bit depth line 356 may illustrate a variable bit depth, including a bit depth that illustrates the bit that travels uphole. The hole depth line 358 may be representative of the hole depth. Because the hole depth will not be reduced, the hole depth line 358 illustrates a stair-step pattern for the hole depth, with periods of steep hole depth advancement when the bit depth line 356 extends deeper, and periods of no hole depth advancement when the bit depth line 356 extends uphole.

The depth plot 348 includes an ROP line 360. The ROP line 360 may be representative of the ROP for the drilling system. The ROP line 360 may be calculated based on the hole depth as illustrated by the hole depth line 358. Because the hole depth line 358 provides the stair-step pattern of increase in hole depth, the ROP line 360 illustrates a variable ROP that extends from zero in the period where the hole depth line 358 illustrates no advancement and a high ROP in the period where the hole depth line 358 illustrates steep hole depth advancement.

During drilling activities on a floating drill rig, the bit may not periodically come off the wellbore bottom. Because of this, the bit depth line 356 may not be representative of the actual position of the bit depth across the entire bit depth line 356. Further, the hole depth line 358 may not be representative of the actual hole depth across the entire bit depth line 356. This may result in the ROP line 360 not being representative of the actual ROP. As may be seen, the variability of the ROP line 360 may make it difficult to analyze trends in ROP and the associated drilling conditions that may be discernable using the ROP.

In FIG. 3-2, a changepoint model has been applied to the block position line 354 to generate a de-sensitized block position line 362. The de-sensitized block position line 362 has been formed using multiple de-sensitized block positions generated using the changepoint model. As may be seen, the de-sensitized block position line 362 is straight, and smooths out the variability in the block position seen in the block position line 354.

Using the de-sensitized block position line 362, a de-sensitized bit and hole depth line 364 may be generated. As discussed herein, the de-sensitized bit and hole depth line 364 may be representative of the actual bit depth and hole depth. As may be seen, the de-sensitized bit and hole depth line 364 may be smoother than the bit depth line 356 and the hole depth line 358. This may result in a smooth ROP based on the hole depth line 358, as may be seen in the de-sensitized ROP line 366.

As may be seen in a comparison between the de-sensitized ROP line 366 and the ROP line 360, the de-sensitized ROP line 366 is steady, without the variability shown in the ROP line 360. In this manner, ROP trends, patterns, and changes may be easily and readily discernable. This may allow a drilling system to identify changes in drilling conditions based on the ROP. As discussed herein, a drilling coordinator may provide instructions to an automated drilling system to implement a change in one or more drilling parameters based on the changed drilling conditions associated with the change in ROP.

Figure 4:
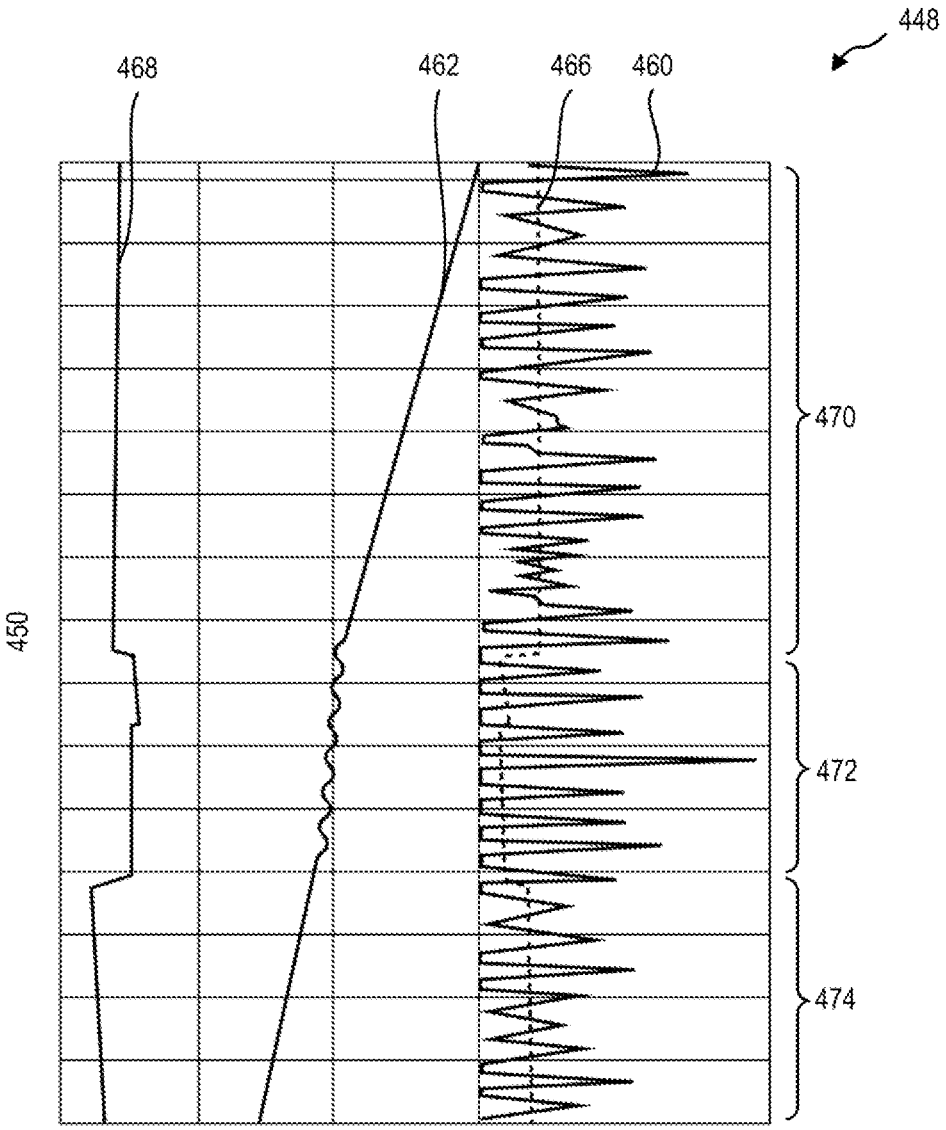
FIG. 4 is a representation of a depth plot for a drilling system, according to at least one embodiment of the present disclosure.

FIG. 4 is a representation of a depth plot 448 for a wellbore illustrating time 450 on the vertical axis (e.g., y-axis), according to at least one embodiment of the present disclosure. The lines on the depth plot 448 are generated using time-based data, including time-based block position data and time-based heave data, as described herein. The depth plot 448 includes a de-sensitized block position line 462. The de-sensitized block position line 462 may be formed from variable block position data that has had a changepoint model applied to it.

The depth plot 448 includes a block position standard deviation line 468. The block position standard deviation line 468 may be representative of the standard deviation of the raw block position data. The depth plot 448 further includes an ROP line 460 and a de-sensitized ROP line 466.

In the embodiment shown, the block position standard deviation line 468, de-sensitized block position line 462, and de-sensitized ROP line 466 illustrate three sections of differing ROP. The first section 470 illustrates a first ROP, represented by a first slope of the de-sensitized block position line 462 in the first section 470 and a first standard deviation in the block position standard deviation line 468. A second section 472 illustrates a second ROP, represented by a second slope of the de-sensitized block position line 462 in the second section 472 and a second standard deviation in the block position standard deviation line 468. A third section 474 illustrates a third ROP, represented by a third slope of the de-sensitized block position line 462 in the third section 474 and a third standard deviation in the block position standard deviation line 468.

As may be seen, the ROP line 460 illustrates significant variability. Such variability may make it difficult to analyze trends in the ROP. After applying the changepoint model to the time-based block-position data, the de-sensitized ROP may be smoothed out, resulting in the de-sensitized ROP line 466. Using the de-sensitized ROP line 466, changes in the ROP may be readily apparent. For example, in the first section 470, the ROP may have a first value. In the second section 472, the ROP may have a second value that is lower than the first. This may indicate that the drilling system has entered a portion of the formation that is harder than in the first section 470, resulting in a lower ROP. The change in ROP may also be indicated by the change in slope of the de-sensitized block position line 462 between the first section 470 and the second section 472. In the third section 474, the ROP has reached a third value, which increases as the hole depth increases. In this manner, using the de-sensitized block position data, the de-sensitized hole position and associated ROP may be used to determine changing drilling conditions of the drilling system.

Figure 5:
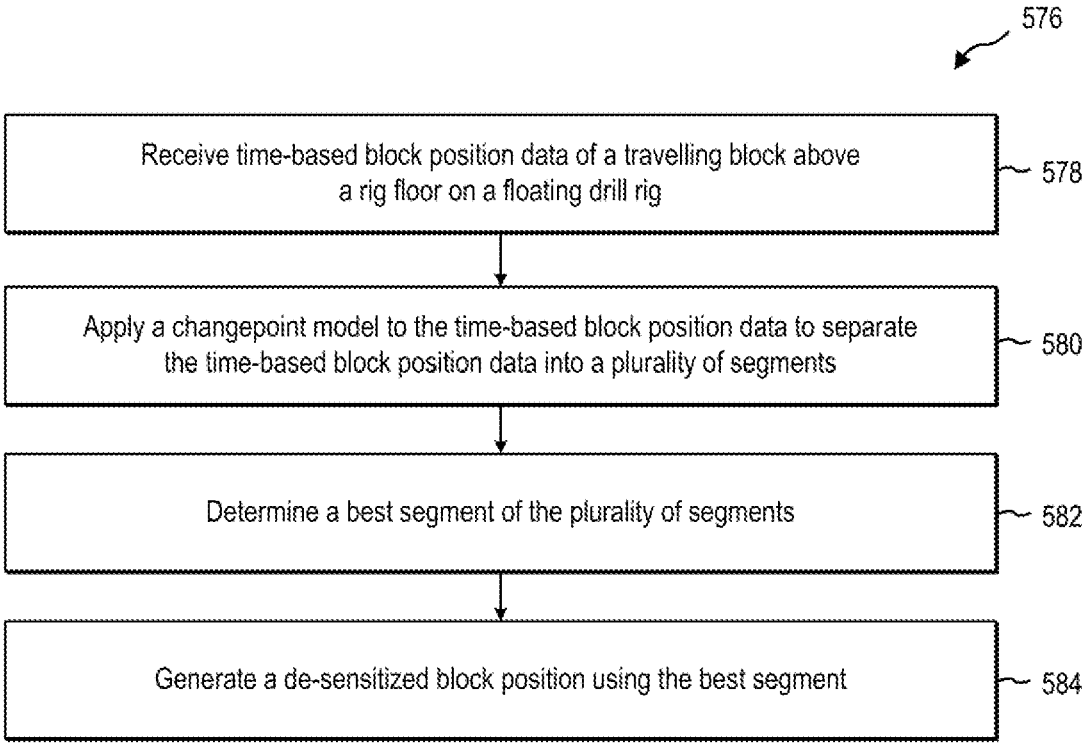
FIG. 5 is a flowchart of a method implemented on a drilling system, according to at least one embodiment of the present disclosure.
Figure 6:
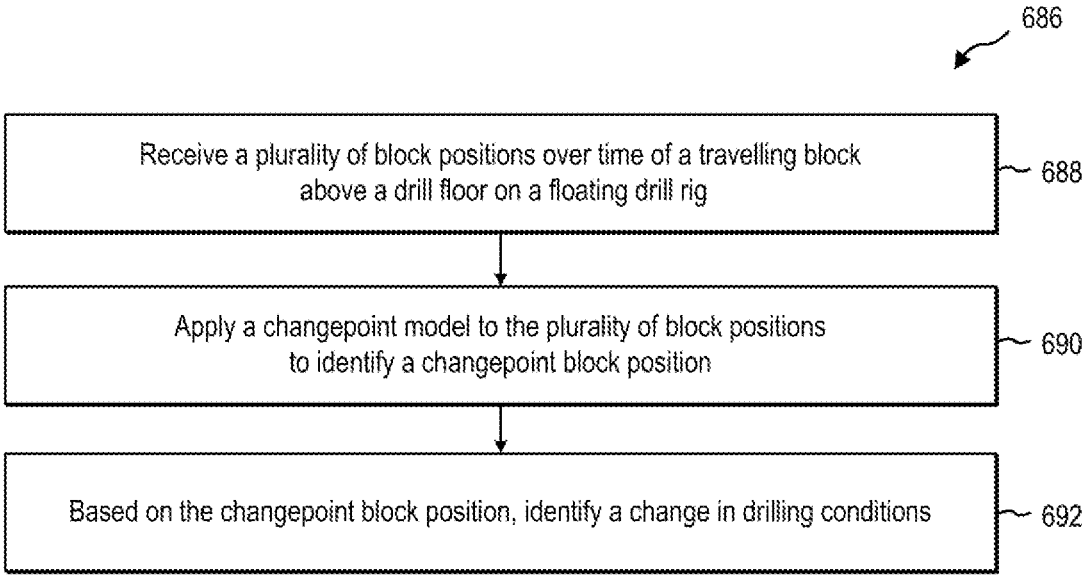
FIG. 6 is a flowchart of a method implemented on a drilling system, according to at least one embodiment of the present disclosure.

FIGS. 5-6, the corresponding text, and the examples provide a number of different methods, systems, devices, and computer-readable media of the position manager 230 illustrated in FIG. 2. In addition to the foregoing, one or more embodiments can also be described in terms of flowcharts comprising acts for accomplishing a particular result, as shown in FIG. 5-6. FIG. 5-6 may be performed with more or fewer acts. Further, the acts may be performed in differing orders. Additionally, the acts described herein may be repeated or performed in parallel with one another or parallel with different instances of the same or similar acts.

As mentioned, FIG. 5 illustrates a flowchart of a method 576, or a series of acts, for drilling, in accordance with one or more embodiments. While FIG. 5 illustrates acts according to one embodiment, alternative embodiments may omit, add to, reorder, and/or modify any of the acts shown in FIG. 5. The acts of FIG. 5 may be performed as part of a method. Alternatively, a computer-readable medium may comprise instructions that, when executed by one or more processors, cause a computing device to perform the acts of FIG. 5. In some embodiments, a system may perform the acts of FIG. 5.

A position manager may receive time-based block position data of a traveling block above a rig floor on a floating drill rig at 578. The time-based block position data may be received from a block position sensor located on the drill floor. The block position sensor may measure the distance between the traveling block and the drill floor. The position manager may apply a changepoint model to the time-based block position data at 580. The changepoint model may separate the time-based block position data into a plurality of segments. Separating the time-based block position data into segments may include generating a segment that is representative of the time-based block position data over a period, such as a period of time and/or a set of measurements.

In some embodiments, applying the changepoint model may include inputting or receiving one or more input thresholds (e.g., priors that work for all or most situations). In some embodiments, the input thresholds may be priors from previous offset wells, and may not utilize any user input. The input thresholds may be the boundaries or thresholds that the changepoint model uses to generate the segments, or to separate the time-based block position data into different segments. In some embodiments, the input thresholds may include any input threshold, such as a block position ranges of block positions (e.g., variability in the block position), a slope cutoff, any other input threshold, and combinations thereof.

In some embodiments, the position manager may determine a best segment of the plurality of segments at 582. For example, the plurality of segments that the changepoint model generates may be overlapping. The position manager may determine which of the overlapping segments is the best segment. To determine the best segment, the position manager may apply a weight to each of the plurality of segments. In some embodiments, a greater weight may be applied to segments that have a better fit to the time-based block position data. In some embodiments, a lower weight may be applied to shorter segments, or segments that are shorter than the average segment of the overlapping segments. In some embodiments, a higher weight may be applied to longer segments, or segments that are longer than the average segment of the overlapping segments. In some embodiments, the segment having the highest weight may be the best segment.

As an illustrative, non-limiting example, consider a set of block position data that generally follows a sine wave. The position manager may identify three segments in the set of block position data, a first portion representative of an upper curve in the sine wave, a second portion representative of the relatively linear section of the sine wave, and a lower portion representative of a lower curve in the sine wave. The position manager may generate a plurality of polynomial formulas that are representative of the first and third sections. The position manager may assign an r value that indicates how close the fit of the polynomial formula is to the data. The position manager may assign the weight to the segment (e.g., the polynomial formula that models the shape of the segment) based on the r value. An r value of 1 (e.g., a perfect correlation) would result in the highest possible weight for the segment, while an r value of 0 (e.g., no correlation) would result in the lowest possible weight. In some embodiments, the position manager may assign a neutral weight to the segment based on a minimum r value. For example, the position manager may assign a neutral weight of 1 to the segment based on an r value of 0.9, and segments having an r value higher than 0.9 would have a weight of greater than 1 and segments having an r value lower than 0.9 would have a weight of less than 1. In this manner, the greater the fit of the data to the segment, the greater the assigned weight. Similarly, the lower the fit of the data to the segment, the lower the assigned weight. The position manager may similarly assign r values to the second segment based on the linear formula.

While the above example has illustrated relative weights with respect to the r value of the formula for the segment, it should be understood that relative weights may be assigned for any metric, as discussed herein. For example, relative weights may be assigned for a length of the segment, where a longer segment beyond an average length may be assigned a higher weight and a shorter segment less than the average weight may be assigned a lower weight. In some examples, a relative weight may be applied to the shape and/or function type of the segment. In some examples, a relative weight may be applied to a slope of the segment. In some examples, any other weighing factor may be assigned a relative weight.

The position manager may generate a de-sensitized block position using the best segment of the plurality of segments at 584. For example, the de-sensitized block position may be the end-point of the best segment. The position manager may generate multiple block positions over time. As discussed herein, the block positions may be associated with bit depth and/or hole depth values. Using the hole depth values over time, the position manager may be used to generate an ROP for the drilling system. The position manager may identify trends in the ROP. Using the trends in the ROP, a drilling coordinator may identify changes in the drilling conditions. The drilling coordinator may, based on the changes in drilling conditions, prepare instructions for the drilling equipment to adjust one or more drilling parameters.

As mentioned, FIG. 6 illustrates a flowchart of a method 686, or a series of acts, for drilling, in accordance with one or more embodiments. While FIG. 6 illustrates acts according to one embodiment, alternative embodiments may omit, add to, reorder, and/or modify any of the acts shown in FIG. 6. The acts of FIG. 6 may be performed as part of a method. Alternatively, a computer-readable medium may comprise instructions that, when executed by one or more processors, cause a computing device to perform the acts of FIG. 6. In some embodiments, a system may perform the acts of FIG. 6.

A position manager may receive a plurality of block positions over time of a traveling block above a rig floor on a floating drill rig at 688. The position manager may receive the block positions from a block position sensor on the drill floor. As discussed herein, the block positions may be associated with a depth of a bit in the wellbore. The position manager may apply a changepoint model to the plurality of block positions to identify a changepoint block position at 690. Based on the changepoint block position, the position manager may identify a change in drilling conditions at 692. In some embodiments, based on the change in drilling conditions, the position manager may adjust a drilling parameter of the drilling system.

In some embodiments, applying the changepoint model includes identifying a plurality of overlapping segments. For example, the changepoint model may identify multiple segments for the same set of block position data. The multiple segments may be different from each other in any manner. For example, the multiple segments may each have a different formula applied to fit the data, with each segment having an associated r value. As discussed herein with respect to relative weights, the position manager may weigh each overlapping segment with a weight. For example, the position manager may assign a relative weight to each overlapping segment based on its associated r value, with an r value of 0.9 as a neutral weight of 1, an r value of greater than 0.9 as a relatively greater weight than 1, and an r value less than 0.9 as a relatively lower weight than 1. The position manager may select a best overlapping segment based on the weight. The de-sensitized block position is based on the best overlapping segment.

In some embodiments, the plurality of block positions may have an amplitude and a frequency. The amplitude and frequency may be representative of a swell that is exposing the drilling system to heave. In some embodiments, the amplitude and frequency may be variable or irregular. This may make conventional systems, such as those based on averages, less accurate. In accordance with at least one embodiment of the present disclosure, the changepoint model may determine de-sensitized block positions using the variable or irregular block positions. The de-sensitized block positions may be used to generate de-sensitized bit positions which may be representative of the actual bit position of the drilling system.

In some embodiments, identifying the change in the drilling conditions includes identifying a change in the formation the bit is drilling through. In some embodiments, identifying the change in the drilling conditions includes identifying a change in the ROP of the drilling system.

Figure 7:
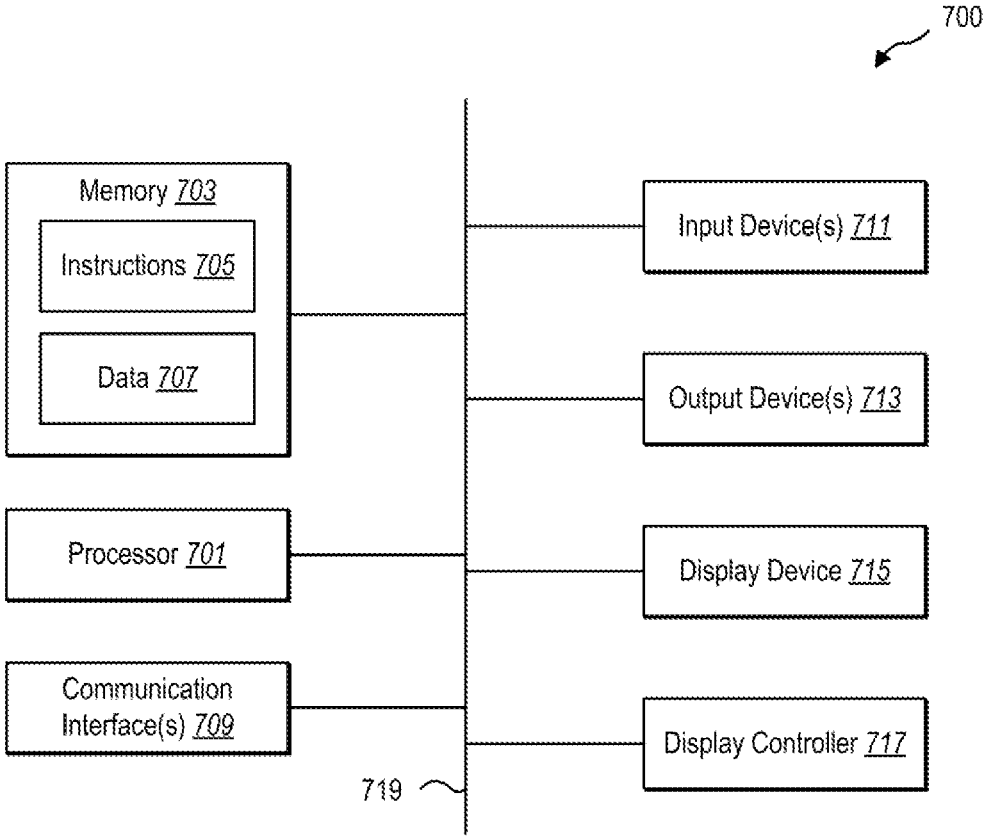
FIG. 7 is a representation of a computing system, according to at least one embodiment of the present disclosure.

FIG. 7 illustrates certain components that may be included within a computer system 700. One or more computer systems 700 may be used to implement the various devices, components, and systems described herein.

The computer system 700 includes a processor 701. The processor 701 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may be any electronic component capable of storing electronic information. For example, the memory 703 may be embodied as random-access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The embodiments of the position manager have been primarily described with reference to wellbore drilling operations; the position managers described herein may be used in applications other than the drilling of a wellbore. In other embodiments, position managers according to the present disclosure may be used outside a wellbore or other downhole environment used for the exploration or production of natural resources. For instance, position managers of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%. or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method, comprising:

receiving time-based block position data of a distance of a travelling block above a drill floor on a floating drill rig experiencing heave at a heave period of between 4 and 15 seconds, wherein:

the time-based block position data is received from a block position sensor on the drill floor periodically with a measurement period of block position measurements of the time-based block position data;

the measurement period is approximately 1 Hz;

the time-based block position data is associated with a depth of a bit in a wellbore; and a measurement multiple of the measurement period to the heave period is between 4 and 15;

applying a changepoint model to the time-based block position data to separate the time-based block position data into a plurality of segments by identifying a changepoint between different segments of the plurality of segments, and wherein at least two segments of the plurality of segments overlap a segment period, and wherein the at least two segments of the plurality of segments have different properties, the different properties including at least one of segment slope, segment length, function type, or fit;

determining a best segment of the plurality of segments;

generating a de-sensitized block position using the best segment of the plurality of segments, wherein the de-sensitized block position is compensated for the heave by removing variability caused by the heave;

using the de-sensitized block position, determining the depth of the bit and a rate of penetration of the bit, wherein the rate of penetration of the bit is compensated for the heave by removing the variability caused by the heave;

using the de-sensitized block position, the depth of the bit, and the rate of penetration of the bit, identifying a change in drilling conditions at the bit; and adjusting a drilling parameter based on the change in drilling conditions.

2. The method of claim 1, wherein applying the changepoint model includes inputting changepoint thresholds, wherein the changepoint thresholds include a block position range.

3. The method of claim 1, wherein determining the best segment includes applying a weight to each of the plurality of segments.

4. The method of claim 3, wherein applying the weight to each of the plurality of segments includes applying a greater weight to segments having a greater r value to the time-based block position data.

5. The method of claim 3, wherein applying the weight to each of the plurality of segments includes applying a lower weight to shorter segments that are shorter than an average length of the plurality of segments.

6. The method of claim 3, wherein determining the best segment includes determining the best segment of the plurality of segments having a highest weight.

7. The method of claim 1, wherein generating the de-sensitized block position includes generating an end-point of the best segment of the plurality of segments.

8. The method of claim 1, wherein the block position sensor includes a single block position sensor.

9. The method of claim 1, wherein receiving the time-based block position data includes receiving the time-based block position data periodically based on a threshold measurement value.

10. A method implemented in a drilling system, comprising:

receiving a plurality of block positions over time of a distance of a travelling block above a drill floor on a floating drill rig experiencing heave at a heave period of between 4 and 15 seconds, wherein:

the plurality of block positions are associated with a depth of a bit in a wellbore;

a measurement period of the plurality of block positions is approximately 1 Hz; and a measurement multiple of the measurement period to the heave period is between 4 and 15;

applying a changepoint model to the plurality of block positions to separate the plurality of block positions into a plurality of segments by identifying a changepoint between different segments of the plurality of segments, and wherein at least two segments of the plurality of segments overlap a segment period, and wherein the at least two segments of the plurality of segments have different properties, the different properties including at least one of segment slope, segment length, function type, or fit, wherein the changepoint model identifies a de-sensitized block position of the plurality of block positions, wherein the de-sensitized block position is compensated for the heave by removing variability caused by the heave;

using the de-sensitized block position, determining the depth of the bit and a rate of penetration of the bit, wherein the rate of penetration of the bit is compensated for the heave by removing the variability caused by the heave;

based on the de-sensitized block position, the depth of the bit, and the rate of penetration of the bit, identifying a change in drilling conditions; and adjusting a drilling parameter based on the change in drilling conditions.

11. The method of claim 10, wherein the at least two segments include a plurality of overlapping segments, and wherein applying the changepoint model includes:

assigning a weight to each overlapping segment of the plurality of overlapping segments, the weight based on the different properties; and selecting a best overlapping segment of the plurality of overlapping segments based on which segment of the plurality of overlapping segments has a highest weight, the de-sensitized block position based on the best overlapping segment.

12. The method of claim 10, wherein the variability is variable in an amplitude and a frequency.

13. The method of claim 10, wherein identifying the change in drilling conditions includes identifying a change in formation.

14. The method of claim 10, wherein identifying the change in drilling conditions includes identifying a change in the rate of penetration.

15. A drilling system, comprising:

a processor and memory, the memory including instructions which cause the processor to:

receive time-based block position data of a distance of a travelling block above a drill floor on a floating drill rig experiencing heave at a heave period of between 4 and 15 seconds, wherein:

the time-based block position data is received from a block position sensor on the drill floor periodically with a measurement period of block position measurements of the time-based block position data;

the measurement period is approximately 1 Hz;

the time-based block position data is associated with a depth of a bit in a wellbore; and a measurement multiple of the measurement period to the heave period is between 4 and 15;

apply a changepoint model to the time-based block position data to separate the time-based block position data into a plurality of segments by identifying a changepoint between different segments of the plurality of segments, and wherein at least two segments of the plurality of segments overlap a segment period, and wherein the at least two segments of the plurality of segments have different properties, the different properties including at least one of segment slope, segment length, function type, or fit;

determine a best segment of the plurality of segments;

generate a de-sensitized block position using the best segment of the plurality of segments, wherein the de-sensitized block position is compensated for the heave by removing variability caused by the heave;

using the de-sensitized block position, determine the depth of the bit and a rate of penetration of the bit, wherein the rate of penetration of the bit is compensated for the heave by removing the variability caused by the heave;

using the de-sensitized block position, the depth of the bit, and the rate of penetration of the bit, identify a change in drilling conditions at the bit; and adjust a drilling parameter based on the change in drilling conditions.

16. The drilling system of claim 15, wherein applying the changepoint model includes inputting changepoint thresholds, wherein the changepoint thresholds include a block position range.

17. The drilling system of claim 15, wherein determining the best segment includes applying a weight to each of the plurality of segments.

18. The drilling system of claim 17, wherein applying the weight to each of the plurality of segments includes applying a greater weight to segments having a higher r value to the time-based block position data.

19. The drilling system of claim 17, wherein applying the weight to each of the plurality of segments includes applying a lower weight to shorter segments that are shorter than an average weight of the plurality of segments.

20. The drilling system of claim 17, wherein determining the best segment includes determining the best segment of the plurality of segments having a highest weight.

* * * * *